US005709231A

United States Patent [19]

Yasuda

[11] Patent Number: 5,709,231

[45] Date of Patent: Jan. 20, 1998

[54] HAIR CLIP

[75] Inventor: Masahiro Yasuda, Osaka, Japan

[73] Assignee: Kabushiki Kaisha Yasuda Corporation, Osakashi, Japan

[21] Appl. No.: 745,611

[22] Filed: Nov. 8, 1996

[51] Int. Cl.[6] ..... A45D 8/24

[52] U.S. Cl. ..... 132/278; 132/279

[58] Field of Search ..... 132/278, 279, 132/275

[56] References Cited

U.S. PATENT DOCUMENTS

| | | | |
|---|---|---|---|
| 2,921,589 | 1/1960 | Blomme | 132/279 |
| 5,259,405 | 11/1993 | Hua-Chou | 132/279 |
| 5,365,955 | 11/1994 | Desgroux et al. | 132/279 |
| 5,445,170 | 8/1995 | Yasuda | 132/279 |
| 5,596,998 | 1/1997 | Yasuda | 132/279 |
| 5,605,166 | 2/1997 | Chou | 132/279 |

FOREIGN PATENT DOCUMENTS

| | | | |
|---|---|---|---|
| 560 672 A1 | 9/1993 | European Pat. Off. . | |
| 921498 | 5/1947 | France | 132/279 |
| 2 635 653 | 3/1990 | France . | |
| 2 713 453 | 6/1995 | France . | |
| 333542 | 2/1921 | Germany | 132/279 |

*Primary Examiner*—Paul J. Hirsch

*Attorney, Agent, or Firm*—Armstrong, Westerman, Hattori, McLeland & Naughton

[57] ABSTRACT

A hair clip includes an elongated base plate having first and second ends, a pair of hooking arms on the base plate first end capable of overlapping each other, and an elongated hair retaining portion having first and second ends. The hair retaining portion further has at the first end thereof an engaging part releasably latched by the pair of hooking arms. An elongated spring board portion having first and second ends is interposed between the base plate and said hair retainer. The spring board is at its second end connected to the second end of the hair retaining portion by way of a bent portion. The base end of the bent portion is slidably retained, along the length of said base plate, to the second end of the base plate.

9 Claims, 6 Drawing Sheets

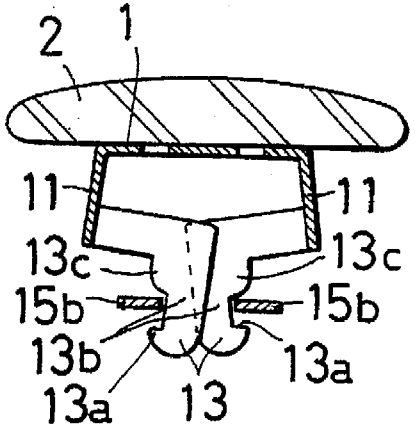
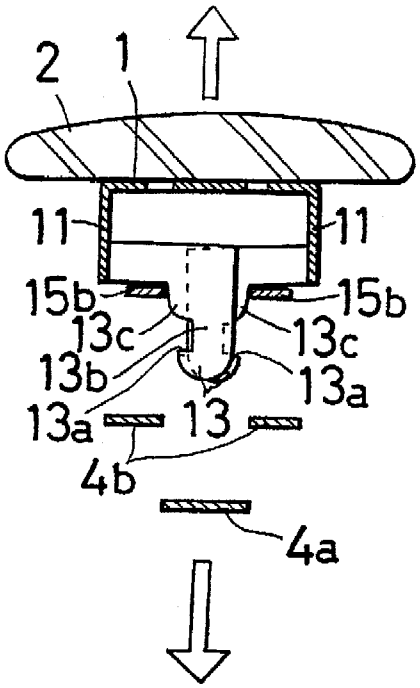
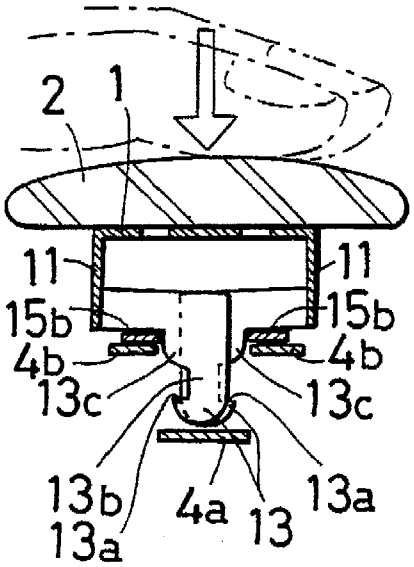
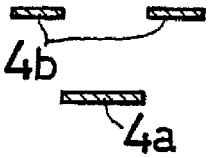
FIG. 4A
FIG. 4B
FIG. 4C

HAIR CLIP

FIELD OF THE INVENTION

This invention relates to a hair clip and, more particularly, to an ornamental hair clip for retaining hairs by a spring force.

BACKGROUND OF THE INVENTION

There are many kinds of hair clips known in the art, and disclosed, for example, in Japanese (unexamined) Utility Model Publication Nos. SHO 45-3321, SHO 50-47698, SHO 50-154195, SHO 57-55403, SHO 61-174504, HEI 176702, Japanese (examined) Patent Publication No. HEI 4-38404, Japanese (unexamined) Patent Publication No. 6-62918 and U.S. Pat. No. 5,445,170. These prior hair clips generally include a band-shaped base plate fixed to an ornamental cover, a downwardly curved and band-shaped spring board whose both ends are slidably fixed to the base plate, and a band-shaped retainer operably disposed beneath the spring board. The retainer has a fixed end pivoted to a pair of brackets protruding from one end of the base plate, and also has a movable end formed with an engaging part which is releasably latched to a pair of hooks provided at the other end of the base plate.

These prior art hair clips retain hairs by and between the spring board and the retainer, with the engaging part thereof being held in place by the hooks. The unlatching operation of these conventional hair clips is performed by gripping the pair of hooks.

However, in these prior hair clips, the retainer is, at the fixed end thereof, pivoted to the base plate as mentioned above. Thus, to retain hairs between the spring board and the retainer, a hair inserting operation has to be done while trying to keep the retainer open at a certain degree from the base plate. Therefore, such a hair inserting operation is somewhat troublesome.

Further, because these prior hair clips include three separate parts, i.e., a base plate, a spring board and a hair retainer, three different types of forming dies are required to form these three parts. Thus, the manufacturing cost becomes expensive. In addition, because these parts are formed separately and then fabricated, the manufacturing efficiency is low.

SUMMARY OF THE INVENTION

An object of the present invention which was made to resolve the aforementioned problems is therefore to provide a hair clip which easily retains hairs and is easy to manufacture and assemble.

According to the present invention, a hair clip includes a relatively elongated base plate having first and second ends, a pair of hooking arms on the base plate first end capable of overlapping each other and a relatively elongated hair retaining portion having first and second ends. The hair retaining portion further has at the first end thereof an engaging part releasably latched by the pair of hooking arms. A relatively elongated spring board portion having first and second ends is interposed between the base plate and the hair retaining portion. The spring beard is at its second end connected to the second end of the hair retaining portion by way of a bent portion having a base end. The base end of the bent portion is slidably retained, along the length of said base plate, to the second end of the base plate.

Since the hair retaining portion is connected to the second end of the spring board portion by way of the bent portion, the hair retaining portion does not freely open and close against the spring board portion, and keeps an opening state with a certain opening angle between the hair retaining portion and the spring board portion when in an unlatched state. Thus, when a hair inserting operation is performed, it is not required for the user to hold the hair retaining portion open at a certain opening angle against the spring board portion. Therefore, the hair-clipping operation is facilitated.

Since the base end of the bent portion is slidably retained, along the length of said base plate, to the second end of the base plate, opening and closing operations of the hair retaining portion can be smoothly done. In detail, when the hair retaining portion is closed, the bent portion will be slightly bent and the base end thereof will be slid toward right end of the base plate while stretching the spring board portion. On the contrary, when the hair retaining portion is opened, the bent portion will be restored to its original configuration and the base end thereof will be slid so as to restore the spring board portion to its original configuration. As detailed above, in a hair clip according to the present invention, the opening and closing operation of the hair retaining portion is done while sliding the base end of the bent portion. Further, the resilient force is restored to both the spring board portion and the hair retaining portion, which is biased toward its opened state by the stress stored in the spring board portion. Therefore, the hair retaining portion will return to its original position when in the unlatched state. In addition, because the opening and closing operation of the hair retaining portion is done while sliding the base end of the bent portion, the base end can withstand a long usage of the hair clip.

The hair retaining portion and the spring board portion can be integrally formed by a forming die. Thus, the cost of the forming die can be reduced and the productivity of the hair clip can be improved. Further, the number of parts can be reduced, thereby enabling an easy management of the parts before fabricating them into a hair clip.

According to the invention, it is desired that the hair retaining portion be connected to the spring board portion with a certain opening angle therebetween via a bent portion when in an unlatched state so as to easily insert the hair retaining portion into hair of a user.

Other objects and advantages of the present invention will become apparent from the description of the preferred embodiments, which may be modified without departing from the scope and spirit of the invention.

BRIEF EXPLANATION OF THE DRAWINGS

FIGS. 4A to 4C are cross-sectional views which correspond to FIG. 3 and illustrate the process of releasing the hair retainer;

DETAILED DESCRIPTION OF THE PREFERRED EMBODIMENT

Preferred embodiments of a hair clip according to the present invention will now be described in detail, with reference to the accompanying drawings.

Figure 1:
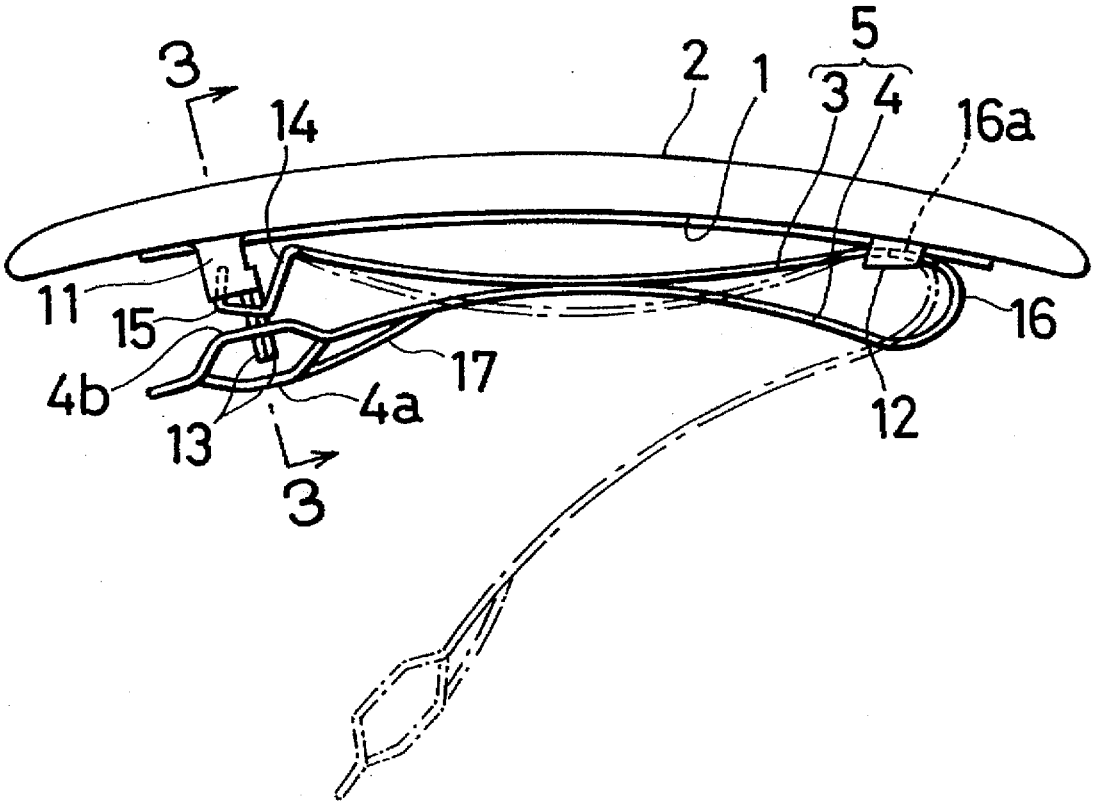
FIG. 1 is a side elevation of a hair clip in closed state according to the present invention.

The words "up" or the like in FIG. 1 are used herein for convenient description of the portions nearer the top edge of the paper, and the words "down" or the like mean the portions nearer the bottom edge.

A hair clip in a preferred embodiment comprises a base plate 1, an ornamental cover 2 and a hair retainer 5 having a spring board portion 3 and a hair retaining portion 4. In FIG. 1, the dot-dash lines illustrate the hair retainer 5 in a released state. The base plate 1 for securing the ornamental cover 2 is preferably made of a metal sheet.

Figure 2:
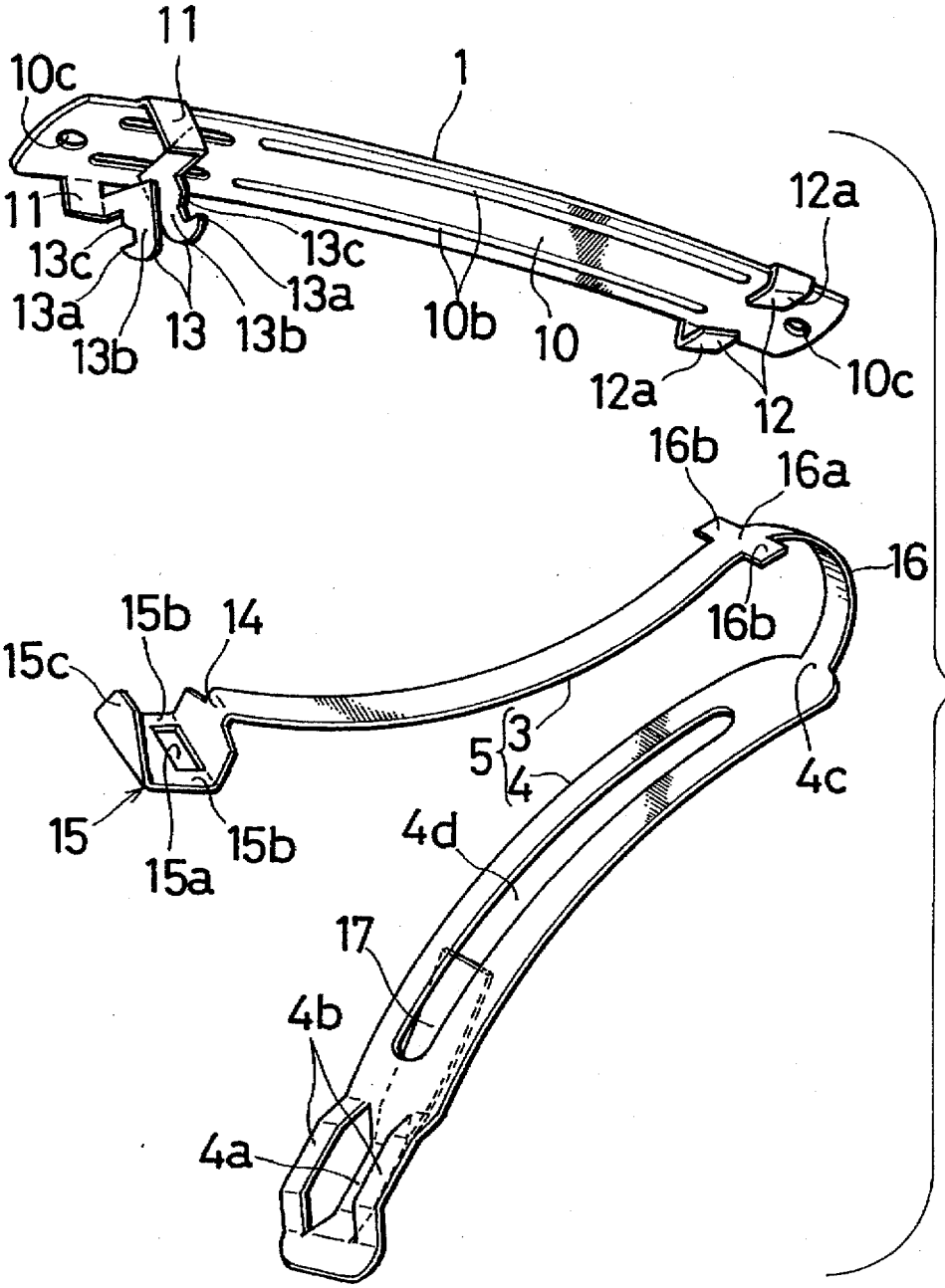
FIG. 2 is a perspective view of a base plate and a hair retainer in a disassembled state, which constitute the hair clip shown in FIG. 1.

As shown in FIG. 2, the base plate 1 is composed of a band-shaped sheet portion 10 which is slightly curved upward, a pair of ledges 11 facing one another and downwardly protruding from opposite sides of the sheet portion 10 at one end, or the left end thereof, and a pair of L-shaped brackets 12 protruding from opposite sides of the sheet portion 10 at the other end, or right end thereof. Each L-shaped bracket 12 has an inwardly bent end portion 12*a*. The bent portions 12*a* slope downwards toward the right end of the base plate 1 so that the right edge of bent portion is closer to the base plate 1 and so that the bent end portion 12*a* extends along the curvature of the right end region of the spring board portion 3.

The band-shaped sheet portion 10 is reinforced with longitudinal ridges 10*b* which protrude downwardly and extend along opposite sides of the portion 10. The ornamental cover 2 is preferably a molded plastics article of a given shape, and is preferably fixed to the upper surface of the base plate 1, by using punched holes 10*c* located at longitudinal end regions thereof. The ornamental cover 2 can be replaced by another article, which can be made of various kinds of materials, and can be of a different shape, sizes, etc. Alternatively, the base plate itself can be used as an ornamental cover.

The distance between the ledges 11 becomes slightly larger toward their lower ends. An L-shaped hooking arm 13 protrudes inwardly from the inner edge of each ledge 11 so as to face the center of the base plate 1. Each of the hooking arms 13 has a vertical leg 13*b*, and these legs always overlap with one another at least partially. As illustrated at the extreme left in FIG. 2, the hooking arms 13 are usually caused by the ledges 11 to open toward their lower ends. The lower ends of the arms 13 are rounded, with their outer edges being shaped serve as hooks 13*a*.

Each vertical leg 13*b* has a clamping member 13*c* which is formed integrally at an outer and upper side thereof. The clamping members 13*c* protrudes outwardly from the leg 13*b* so as to form a contactable extension, e.g. a cam, which constitutes a releasing means detailed as discussed below. The lower edges of the clamping member 13*c* are arcuate.

The hair retainer 5 comprising the spring board portion 3 and the hair retaining portion 4 is an integral elongate band-shaped piece made of resilient, i.e. springable, steel. The spring board portion 3 has an intermediate region bent downward (as shown in FIG. 1) between its ends and disposed beneath the base plate 1. The spring board portion 3 includes an annular frame 15 as a releasing means connected the left end of the spring board portion 3 via a connecting portion 14. As shown in FIG. 1, the annular frame 15 is preferably positioned so as to slope downward in the direction of the left end of the base plate 1, and has a central rectangular opening 15*a* of such a size as to allow insertion of the lower portions of the hooking arms 13.

Figure 3:
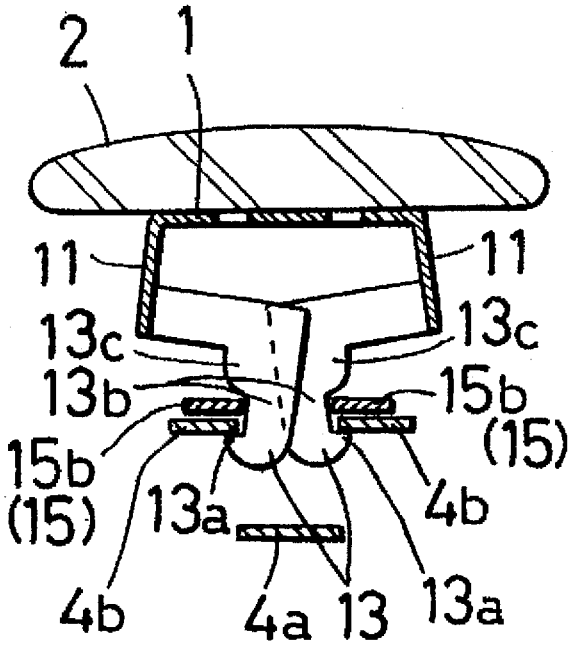
FIG. 3 is a cross-sectional view taken along the line 3—3 in FIG. 1.

As shown in FIG. 3, the hooking arms 13 are inserted in the opening 15*a* of the annular frame 15 so that the leading end of the spring board portion 3 is engaged with the hooking arms 13. Thus, the leading end of the spring board portion 3 is fixed to the left end of the base plate 1. In the state shown in FIG. 3, the restrainers 15*b* of the releasing member 15 are disposed between the hook 13*a* and each clamping member 13*c*, i.e., the contactable extension. An outer end of the annular frame 15 is bent upward toward the base plate 1 so as to form a stopper 15*c*, as shown in FIGS. 1 and 2.

The spring board portion 3 is, at its the other end (or right end thereof), connected to an U-shaped bent portion 16. The base end 16*a* of the bent portion 16 has a pair of ledges 16*b*, 16*b* protruding from both sides of the base end 16*a*.

The hair retaining portion 4 is connected to the spring board portion 3 via the U-shaped bent portion 16 and the left end portion of the hair retaining portion 4 is normally positioned apart from the annular frame 15 of the spring board portion 3. The hair retaining portion 4 is a band-shaped steel spring, and its middle region intermediate the longitudinal ends is slightly curved upward.

The hair retaining portion 4 has a left-hand end formed with two parallel slits extending longitudinally along the retaining portion 4 at the left end thereof. A middle portion between the slits is a downwardly dented part 4*a*, which is interposed between two parallel and outer arched bridges 4*b*, which in turn are curved upward to serve as an engaging part. A slot 4*d*, which extends longitudinally along the hair retaining portion 4, is preferably provided in the middle region thereof.

A band-shaped reinforcing strip 17 is disposed beneath the left end of the hair retaining portion 4 with one end brazed, or welded, to the downwardly dented part 4*a* and the other end brazed, or welded to the hair retaining portion 4.

The ledges 16*b* at the U-shaped bent portion 16 are disposable between the corresponding bent end portions 12*a* of the L-shaped brackets 12 and the base plate 1 so that the base end 16*a* at the U-shaped portion 16 can be slidably engaged to the L-shaped brackets 12 in the longitudinal direction of the base plate 1. When the hair retaining portion 4 is pressed toward its closed position, the U-shaped bent portion 16 will be further bent and the base end 16*a* will be slightly slid toward the right end of the base plate 1 while stretching the spring board portion 3. Similarly, if the arched bridges 4*b* of the hair retaining portion 4 are disengaged from the hooks 13*a* of the base plate 1, the spring board portion 3 will be restored to its original downwardly curved configuration by the resilient force thereof with the right end of the spring board portion 3 being slid toward the left end of the base plate 1. Thus, the hair retaining portion 4 will be returned to its original position having a certain opening angle from the base plate 1.

As described above, the hair retainer 5 comprising the spring board portion 3 and the hair retaining portion 4 will be opened and closed around the base end 16*a* of the U-shaped bend portion 16 acting as a fulcrum so that hair of a user is releasably clipped between the spring board portion 3 and the hair retaining portion 4.

In detail, the hair clip can be closed on one's the hair and released therefrom in the following manner. One's hair is inserted between the spring board portion 3 and the hair retaining portion 4. Then the hair retaining portion 4 is swung toward its closed position. By closing the hair retaining portion 4, the U-shaped bent portion 16 will be further bent and the base end 16*a* will be slightly slid toward the right end of the base plate 1 while stretching the spring board portion 3, and thus the resilient force is restored to the spring board portion 3. Thus, the hair retaining portion 4 is imparted toward its opened state by the stress stored in the spring board portion 3.

With the movable end of the hair retaining portion 4 being pressed, the base end 16*a* of the U-shaped bent portion 16 will be slid toward the right end of the base plate 1 while stretching the spring board portion 3, and the inner edges of the arched bridges 4*b*, as the engaging part, will contact the lower ends of the vertical legs 13*b*.

With the movable end of the hair retaining portion 4 being further pressed, the inner edges of the arched bridges 4*b* will subsequently be guided toward the upper base ends of the vertical legs 13*b*, which will therefore be forced to more completely overlap each other.

When the arched bridges 4*b* pass the hooks 13*a*, the hooking arms 13 will spring open due to the resilient force which has been imparted thereto, whereby the bridges 4*b* as the engaging part are latched by the hooks 13*a*. In this latched state (as shown in FIG. 3), a pair of restrainers 15*b* of the annular frame 15 are located outside the hooking arms 13 and fit thereon between the upper clamping extensions 13*c* and lower hooks 13*a*. Further, in this latched state, the hair retaining portion 4 at its middle portion indirectly presses against the spring board portion 3 via one's hair. Thus, the hair retaining portion 4 is imparted toward its opened state by the stress stored in the spring board portion 3 via the U-shaped bent portion 16.

The release of the latched engaging part is effected by causing the vertical legs 13*b* of the hooking arms 13 to more completely overlap each other. At first, the movable end of the hair retainer 4 is moved toward the base plate 1. In consequence of this motion, the arched bridges 4*b* (as the engaging part) come into engagement with the restrainers 15*b* of the annular frame 15, and then the inner edges of the restrainers 15*b* are forced into contact with the lower arcuate edges of clamping extensions 13*c* of the hooking arms 13. Thus, the arched bridges 4*b* indirectly engage the extensions 13*c*, with the restrainers 15*b* intervening between them.

Figure 5A:
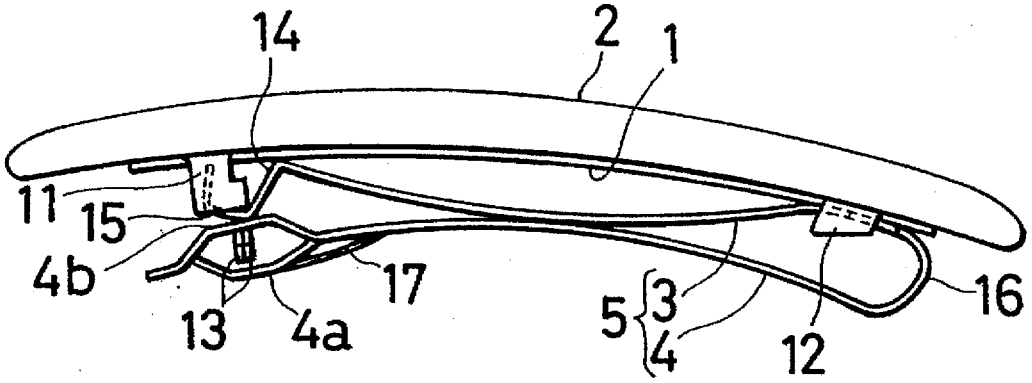
FIGS. 5A to 5C are side elevations which correspond to FIG. 1 and similarly illustrate the releasing process.
Figure 6A:
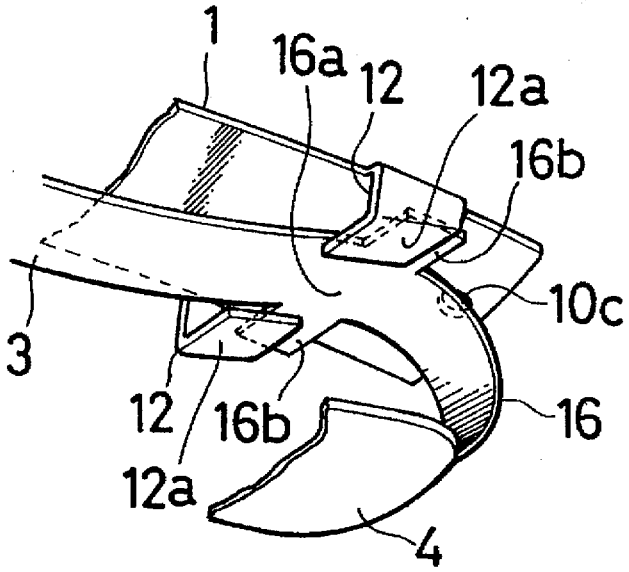
FIGS. 6A to 6C are partial perspective views of the bent portion of the hair retainer and illustrate the process of releasing the hair retainer.
Figure 6B:
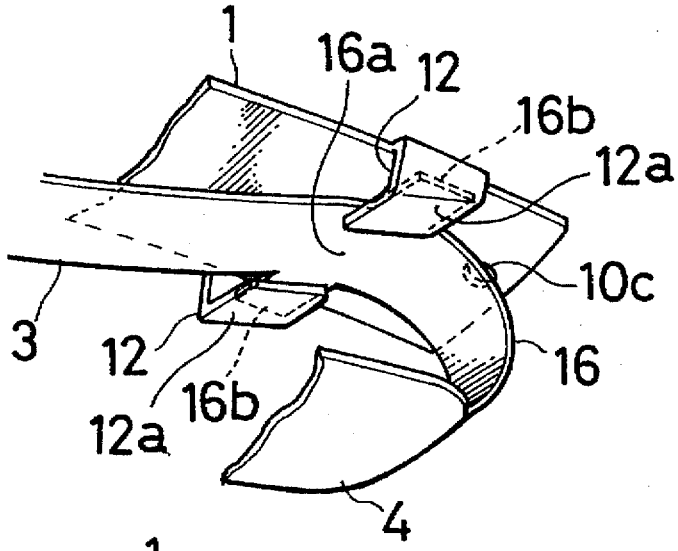
Figure 6C:
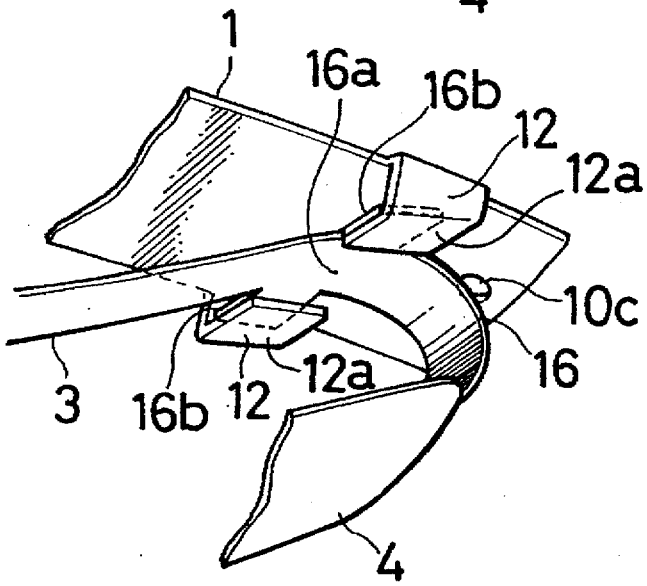

As the hair retainer portion 4 further advances toward the base plate 1, the restrainers 15*b* will be caused to slide upwards along the clamping members 13*c*. As a result, the vertical legs 13*b* of the hooking arms 13 will fully overlap each other, as shown in FIG. 4A. In this unlatched state of the arched bridges 4*b*, the hooks 13*a* are spaced therefrom, and the stopper 15*c* which has been brought into contact with the base plate 1 will prevent the hair retaining portion from being displaced any further toward the base plate 1 as shown in FIG. 5A. In this state, the base end 16*a* of the U-shaped bent portion 16 is positioned at the rightmost position of the L-shaped brackets 12 as shown in FIG. 6A. Upon removal of the pressure which has been imparted to the movable end of the hair retaining portion 4, the stress stored in the spring board portion 3 and the hair retaining portion 4 will instantaneously repel the latter away from the base plate 1, sliding the base end 16*a* of the U-shaped bent portion 16 toward left and rotating the hair retaining portion 4 toward its open position. The arched bridges 4*b* will thus be displaced downwardly around the hooks 13*a*.

Figure 5B:
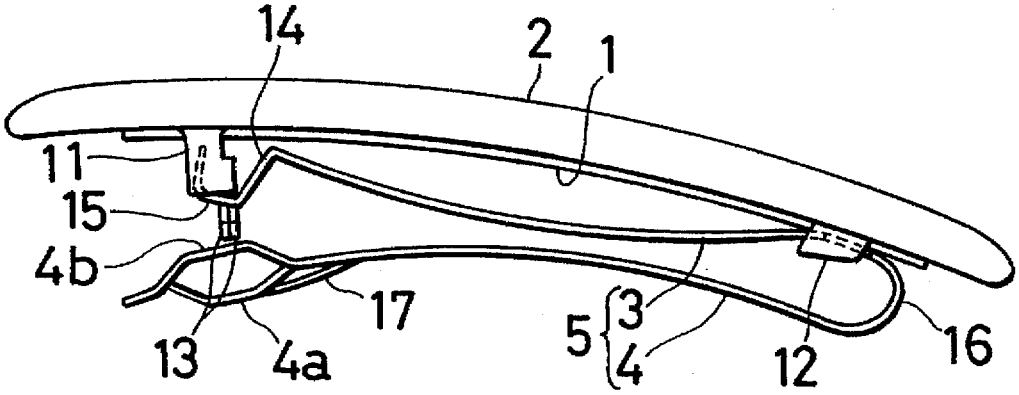

In this state shown in FIGS. 4B and 5B, the restrainers 15*b* of the annular frame 15 are still on the clamping member 13*c* of the hooking arms 13, due to their frictional resistance. Thus, the restrainers 15*b* can be considered to be temporarily held by the upper ends of the clamping members 13*c* which also can be considered to be holding means.

Figure 5C:
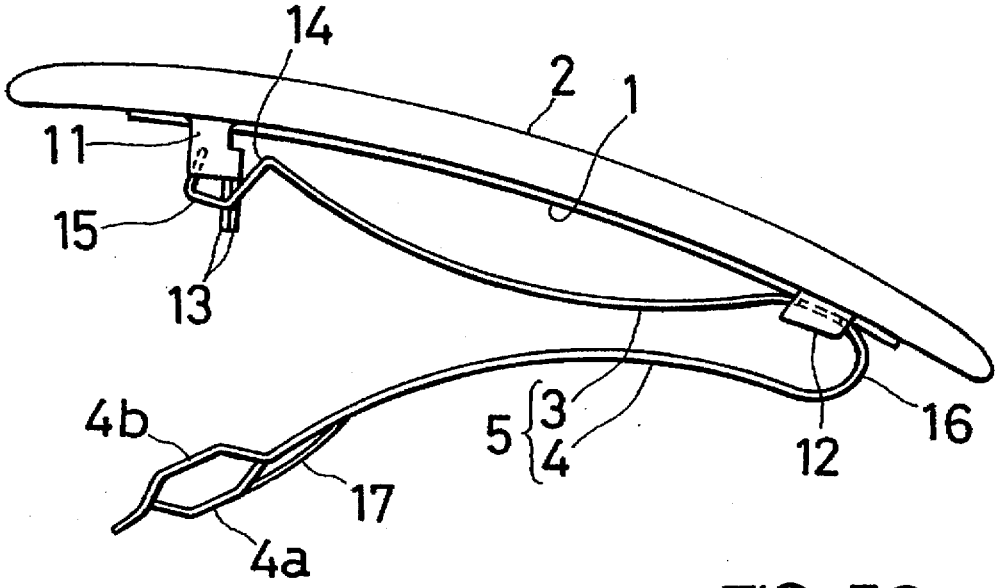

When the hair retaining portion 4 further rotates toward its open position, into a state shown in FIGS. 4C and 5C, the base end 16*a* of the U-shaped bent portion 16 will be further slide toward left. Thus, the spring board portion 3 returns to its downwardly curved position, thereby increasing the angle of the restrainers 15*b* against the base plate 1. As a result of the increase of the angle, the restrainers 15*b* will be urged toward the hooks 13*a* by abutting the upper end of the stopper 15*c* which acts as a fulcrum to the base plate. Thus, the restrainers 15*b* move back toward their position between the clamping members 13*c* and the hooks 13*a*, whereby the hooking arms 13 resume their home position and the vertical legs 13*b* are opened outward.

It will be understood that the hair clip of the present invention can also be opened in a similar manner as in prior art hair clips. In other words, the ledges 11 may be gripped between ones fingers to press the ledges 11 toward each other in order to cause the vertical legs 13*b* of the hooking arms 13 to overlap each other, to thereby disengage the hooks 13*a* from the arched bridges 4*b* as the engaging part. It also may be possible to provide each leg 11 with a tab or the like (not shown) to facilitate the unlatching operation.

As already detailed above, the spring board portion 3 has at one end a releasing means 15 and is fixed to the base plate 1 by engaging the releasing means 15 with the hooking arms 13. Providing the releasing means 15 on the spring board portion 3 facilitates the unlatching operation. However, it should be understood that the present invention is not limited to this embodiment. For example, a spring board portion having no releasing means can be used, such as wherein one end of the spring board portion is directly brazed to the left end of the base plate 1.

As already described above, the hair retainer 5 is an integral piece wherein the spring board portion 3 is integrally formed with the hair retaining portion 4. Forming the hair retainer 5 as an integral piece can reduce the cost of manufacturing the die assembly and can facilitate the productivity of the hair retainer 5. However, the present invention is not limited to this embodiment. For example, a spring board portion 3 and a hair retaining portion 4 may be produced separately and then brazed to form a hair retainer 5.

In the detailed embodiment, the hair retaining portion 4 is connected to the spring board portion 3 via the U-shaped bent portion 16 with a certain predetermined opening angle their between. However, the present invention is not especially limited to the specified opening angle.

As detailed above, according to the present preferred embodiments of the invention, a hair clip includes a relatively elongated base plate having first and second ends, a pair of hooking arms on the base plate first end capable of overlapping each other and a relatively elongated hair retaining portion having first and second ends. The hair retaining portion further has at the first end thereof an engaging part releasably latched by the pair of hooking arms. A relatively elongated spring board portion having first and second ends is interposed between the base plate and the hair retaining portion. The spring board is at its second end connected to the second end of the hair retaining portion by way of a bent portion having a base end. The base end of the bent portion is slidably retained, along the length of said base plate, to the second end of the base plate.

Since the hair retaining portion is connected to the second end of the spring board portion by way of the bent portion, the hair retaining portion keeps an opened state with a certain opening angle between the hair retaining portion and the spring board portion when in an unlatched state. Thus, when a hair inserting operation is performed, it is not required to hold the hair retaining portion so that the hair retaining portion opens at a certain opening angle against the spring board portion, thereby enabling an easy hair-clipping operation.

Since the base end of the bent portion is slidably retained, along the length of said base plate, to the second end of the base plate, the resilient force restored in the spring board portion is effectively conveyed to the hair retaining portion, thereby enabling smooth opening and closing operations of the hair retaining portion.

In addition, the hair retaining portion and the spring board portion can be integrally formed by a forming die. Thus, the number of the parts can be reduced and the cost of the forming die can be reduced, the productivity of the hair clip can be improved.

Since the base end of the bent portion is slidably retained, along the length of said base plate, to the second end of the base plate, the opening and closing operation of the hair retaining portion is done while sliding the base end of the bent portion. As a result, the hair retainer including the spring board portion, the bent portion and the hair retaining portion can stand repeated closing and opening operations of the hair retaining portion, and a hair clip having a considerable endurance can be provided.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A hair clip, comprising:

a relatively elongated base plate having first and second ends;

a pair of hooking arms on said base plate first end capable of overlapping each other;

a relatively elongated hair retaining portion having first and second ends, said hair retaining portion further having at the first end thereof an engaging part releasably latched by said pair of hooking arms; and a relatively elongated spring board portion having first and second ends and interposed between said base plate and said hair retaining portion;

wherein said spring beard portion is at its second end connected to the second end of said hair retaining portion by way of a bent portion, the bent portion having a base end, and wherein the base end of the bent portion is slidably retained, along the length of said base plate, to the second end of the base plate.

2. A hair clip as recited in claim 1, wherein said spring board portion is connected to said hair retaining portion with a certain angle therebetween.

3. A hair retainer as recited in claim 1, wherein the base end of the bent portion has a pair of ledges at both sides of the base end, and the second end of said base plate has a pair of brackets facing each other, and wherein the ledges are positioned between the corresponding brackets and the second end of the base plate so that the base end of the bent portion is movable along the length of the base plate.

4. A hair clip as recited in claim 1, 2 or 3, further including a releasing means at the first end of said spring board portion for causing the hooking arms to overlap each other to take a releasing position when the first end of said base plate is pressed toward the first end of said hair retaining portion when in its latched position, said releasing means being engaged with the hooking arms so as to fix the first end of said spring board portion to the first end of said base plate.

5. A hair clip as recited in claim 4, wherein said releasing means includes clamping members each protruding outwardly from each hooking arm base portion so as to come into a contacting relationship with the engaging part, the clamping members being shaped such that when the first end of said base plate is pressed toward the first end of said hair retaining portion when in its latched position, the hooking arms are caused to overlap each other to take a releasing position, a pair of restrainers operably associated with said hair retaining portion and said spring board portion and shaped to hold the hooking arms in their overlapping state even after they have taken the releasing position, and restoring means operably associated with said hair retaining portion and said spring board portion and shaped to urge the restrainers toward a free position for releasing the hooking arms as said hair retaining portion is rotated away from said base plate toward its open state in which the engaging part is no longer latched by the hooking arms.

6. A hair clip as recited in claim 5, wherein the restrainers and clamping members are frictionably engaged at the beginning of the releasing position.

7. A hair clip as recited in claim 5, wherein each hooking arm has an upper end connected to said base plate, a free lower end, inner and outer vertically extending sides between said upper and lower ends, said inner sides being adjacent, and a hook protruding from each arm outer side.

8. A hair clip as recited in claim 7, wherein the hook is located a spaced distance from its associated clamping member.

9. A hair clip as recited in claim 1, further including an ornamental cover mounted on said base plate.

* * * * *